US006973699B2

(12) United States Patent
Leder

(10) Patent No.: US 6,973,699 B2
(45) Date of Patent: Dec. 13, 2005

(54) DEVICE ON A CARDING MACHINE FOR SETTING THE WORKING GAP BETWEEN THE CYLINDER AND AT LEAST ONE NEIGHBORING ROLLER

(75) Inventor: Armin Leder, Mönchengladbach (DE)

(73) Assignee: Trutzschler GmbH & Co. KG, Monchengladbach (DE)

( * ) Notice: Subject to any disclaimer, the term of this patent is extended or adjusted under 35 U.S.C. 154(b) by 0 days.

(21) Appl. No.: 10/768,702

(22) Filed: Feb. 2, 2004

(65) Prior Publication Data

US 2004/0154135 A1 Aug. 12, 2004

(30) Foreign Application Priority Data

Feb. 7, 2003 (DE) ..... 103 05 048

(51) Int. Cl.[7] ..... D01G 15/00
(52) U.S. Cl. ..... 19/98
(58) Field of Search ..... 19/98, 99, 102, 19/103, 104, 105, 106 R, 111, 113, 114

(56) References Cited

U.S. PATENT DOCUMENTS 4,384,388 A 5/1983 Mondini
5,040,272 A * 8/1991 Fritzsche ..... 19/104
5,127,134 A * 7/1992 Demuth et al. ..... 19/102
6,282,754 B1 * 9/2001 Leder ..... 19/98
2002/0069486 A1 6/2002 Wust et al.

FOREIGN PATENT DOCUMENTS

| | | |
|---|---|---|
| DE | 29 48 825 C2 | 12/1980 |
| DE | 39 41 770 A1 | 7/1990 |
| DE | 39 13 996 A1 | 8/1990 |
| EP | 1 231 303 A1 | 8/2002 |
| GB | 2 386 131 A1 | 9/2003 |

* cited by examiner

*Primary Examiner*—Gary L. Welch
(74) *Attorney, Agent, or Firm*—Venable LLP; Robert Kinberg; Edward W. Yee

(57) ABSTRACT

In a device on a carding machine for setting the working gap between the cylinder and a neighboring roller, which cooperate with one another with a working gap between their cylindrical surfaces at the fiber transfer points, the working gap is readjustable as a result of changes in dimensions caused by thermal expansion and/or centrifugal forces. If the dimensions of the rollers change, it is readily possible to set substantially the same gap between neighboring rollers. The temperature of the framework walls carrying the cylinder can be matched to the working gap by supplying or discharging heat. If the dimensions of the rollers change, the working gap substantially the same.

21 Claims, 3 Drawing Sheets

DEVICE ON A CARDING MACHINE FOR SETTING THE WORKING GAP BETWEEN THE CYLINDER AND AT LEAST ONE NEIGHBORING ROLLER

CROSS REFERENCE TO RELATED APPLICATION

This application claims priority from German Patent Application No. 103 05 048.5, which is incorporated herein by reference.

BACKGROUND OF THE INVENTION

The invention relates to a device on a carding machine for setting the working gap between the cylinder and at least one neighbouring roller, which cooperate with one another with a small gap between their cylindrical surfaces (working gap) at the fibre transfer points.

The working gap may be readjustable to a pre-determined value as a result of changes in dimensions caused by thermal expansion and/or centrifugal forces. In carding, increasingly large amounts of fibre material are processed per unit of time, which requires higher working component speeds and higher performance. The increasing throughput of fibre material (production rate), even when the working surface area remains constant, results in increased generation of heat as a result of the mechanical work. At the same time, however, the technological carding result (sliver uniformity, degree of cleaning, nep reduction etc.) is constantly being improved, which requires a greater number of effective surfaces in carding engagement and narrower settings of those effective surfaces, e.g. fixed card tops and/or revolving card tops, with respect to the cylinder (tambour). The proportion of synthetic fibres being processed, which—compared with cotton—generate more heat as a result of friction when in contact with the effective surfaces (clothings) of the machine, is continually increasing. The working components of high performance carding machines are nowadays totally enclosed on all sides in order to conform to the high safety standards, to prevent the emission of particles into the spinning room environment and to minimise the need for servicing of the machines. Grids or even open, material-guiding surfaces allowing exchange of air are largely a thing of the past. The said circumstances markedly increase the input of heat into the machine, while the discharge of heat by means of convection is markedly reduced. The resulting more intense heating of high performance carding machines leads to greater thermo-elastic deformation which, on account of the non-uniform distribution of the temperature field, affects the set spacings of the effective surfaces: the gaps between cylinder and card top, doffer, fixed card tops and separation points are reduced. In an extreme case, the set gap between the effective surfaces can be completely consumed by thermal expansion, so that components moving relative to one another collide, resulting in considerable damage to the affected high performance carding machine. Accordingly, particularly the generation of heat in the working region of the carding machine can lead to different degrees of thermal expansion when the temperature differences between the components are too great.

Carding gaps and roller spacings on a carding machine are extraordinarily important. The carding quality stands or falls with the exact setting of those gaps (roller gaps). Under the action of heat, the rollers expand and the gaps change. In addition to expansion of the rollers caused by centrifugal force, which greatly changes the gaps, a high production rate and carding-intensive synthetic fibres additionally give rise to intense heating of the rollers. Thermally induced changes in the dimensions of the rollers occur. In order to achieve optimum carding quality it is necessary for the roller spacings to remain constant during operation. "Constant" means in this context that the change in spacing should be preferably less than 0.01 mm.

In a known device (DE 29 48 825), in a carding machine having at least two cooperating rollers the gap between the two rollers is changed in order to compensate for heating. This change is effected by means of additional mechanical displacement elements which are so constructed that they are able to change the spacing of the axes of the rollers in accordance with the prevailing temperature. For that purpose, the stationary framework of the carding machine is in the form of a frame having four supports (only two are shown) and having two horizontal longitudinal bars (only one is shown). The two longitudinal bars and the supports are joined together by crossbars (not shown) to form a stable, rigid support frame for two rotating rollers (cylinder and doffer) which are equipped with pointed clothing and operate a short distance a apart. The cylinder is fixedly mounted so as to be rotatable about its axis by means of two bearings (of which only one is shown) which are tightly screwed to the longitudinal bars by means of screws, and is driven and rotated. The doffer is likewise mounted so as to be rotatable about its axis by means of two bearings (only one is shown) on the longitudinal bars of the framework. The bearings for the doffer are not, however, tightly screwed to longitudinal bars but are each guided by means of two collar screws so that they are displaceable parallel to the axis by a small amount of the order of 1 to 2 mm. For that purpose, slot openings are provided in the bearings for the projecting screws, which allow exact lateral guidance of the bearings while ensuring their displaceability in the longitudinal direction. By parallel displacement of the bearings in the slot openings, the gap between the cylindrical surfaces of the two rollers can be varied. For that purpose, the machinery framework is provided on each of its longitudinal bars with a fixed stop for adjusting devices (displacement elements) which are inserted between the fixed stop and the bearing of the doffer. The adjusting devices are capable of determining the position of their corresponding bearing in respect of that of the fixed bearing for the cylinder. A disadvantage of this device is the structural complexity. Additional separate mechanical adjusting elements are required for displacement. A particular shortcoming is that the bearings of the high-speed doffer are displaceably arranged. In addition to the apparatus-related expense for the displacement elements on the bearings, the fact that the bearing arrangement for the heavy doffer roller is not completely rigid is a particular disadvantage. Displacement of the doffer that is only very slightly unequal results in a non-uniform roller gap and can lead to the destruction of the machine. In the known device, in every case the bearings of the doffer have to be loosened for adjustment and then fixed again.

It is an aim of the invention to provide a device of the kind described at the beginning which avoids or mitigates the mentioned disadvantages, which has an especially simple structure and enables a predetermined spacing between neighbouring rollers to be set in a simple manner in the event of changes in the dimensions of the rollers.

SUMMARY OF THE INVENTION

The invention provides a carding machine having a carding cylinder and at least a first cooperating device in cooperating relationship with the carding cylinder, comprising an adjusting device for setting a working gap between the carding cylinder and said first cooperating device, the adjusting device comprising a thermal device for adjusting the temperature of a support member of the cylinder.

As a result of the features according to the invention it is possible in a simple manner to maintain constant roller spacings in carding machines under the action of heat. The machinery framework can be partitioned thermally in such a manner that the cylinder is raised by heating of its supports, which are "insulated" from the remainder of the framework. On so doing, the gap between the cylinder and at least one neighbouring roller, for example licker-in and/or doffer, is changed. In this way, compensation of the roller diameter changed by the change in temperature can be realised in a specific manner and with a low heat output. Special further advantages are that separate adjusting elements for the displacement of a roller and the mechanical and fibre-technological problems associated with roller displacement are substantially or completely avoided. The roller gap can be made to track a change in temperature automatically, without the need to loosen, displace and then fix a bearing for a roller on the framework. The bearings of the rollers can remain rigidly connected to the framework.

The first cooperating device may be a clothed roller, for example, a doffer. The machine may comprise a second cooperating device, for example, a licker-in. Advantageously, the thermal device is so arranged that the temperature of the support member can be so matched to the working gap that, in the event of a change in the dimensions of the cylinder the working gap can be set or readjusted.

Advantageously, a framework wall is provided with means for heating at least one element of the framework wall. The framework wall may have a heating element. The heating element may be integrated into the framework wall.

The framework wall may have at least two support struts on each side. The support struts may have a crossmember. The framework walls may be expandable. The support struts may be expandable or contractable in the vertical direction. The cylinder and at least one neighbouring roller may be arranged on their own framework walls or struts. The framework of the cylinder is advantageously higher than the framework of at least one neighbouring roller. The heating element is then advantageously arranged in the region of the cylinder framework that projects above the frameworks of a neighbouring roller. The separate neighbouring frameworks may be connected to one another, for example by welding.

Advantageously, the temperature to be set is determined in accordance with the relationship: $\Delta a = R \times \alpha \times \Delta T$. Advantageously, the spacings of the rollers are settable by an electronic control and regulating device. The electronic control and regulating device may have a memory for desired values for the roller gaps (working gaps). The predetermined roller gaps may be constant. The cylinder may be associated with at least one temperature-measuring element. The doffer may be associated with at least one temperature-measuring element. At least one licker-in may be associated with at least one temperature-measuring element. The temperature-measuring elements may be associated with the surfaces of the rollers. The temperature-measuring elements may be connected to the electronic control and regulating device. The temperature-measuring element may be in the form of a temperature sensor for the temperature of the roller surface. There may be a gap-measuring element for the gap between two neighbouring rollers. The gap-measuring element may be connected to the electronic control and regulating device. The gap-measuring element may be an inductive sensor. The gap-measuring element may be an optical sensor, for example a laser sensor. The gap-measuring element may be able to measure the working gap between two neighbouring rollers. The heating element may be connected to the electronic control and regulating device. There may be at least one heating element on each side of the carding machine. The temperature of the heating elements may be adjustable. The temperature adjustment may be effected stepwise. The temperature adjustment may be effected steplessly.

The invention further provides a device on a carding machine for setting the working gap between the cylinder and at least one neighbouring roller, which cooperate with one another with a small gap between their cylindrical surfaces (working gap) at the fibre transfer points and in which the working gap is readjustable to a pre-determined value as a result of changes in dimensions caused by thermal expansion and/or centrifugal forces, characterised in that the temperature of the framework walls carrying the cylinder can be so matched to the working gap by means of devices for supplying or discharging heat that in the event of a change in the dimensions of the rollers the working gap between the cylinder and at least one neighbouring roller can be set or readjusted.

DESCRIPTION OF THE PREFERRED EMBODIMENTS

Figure 1:
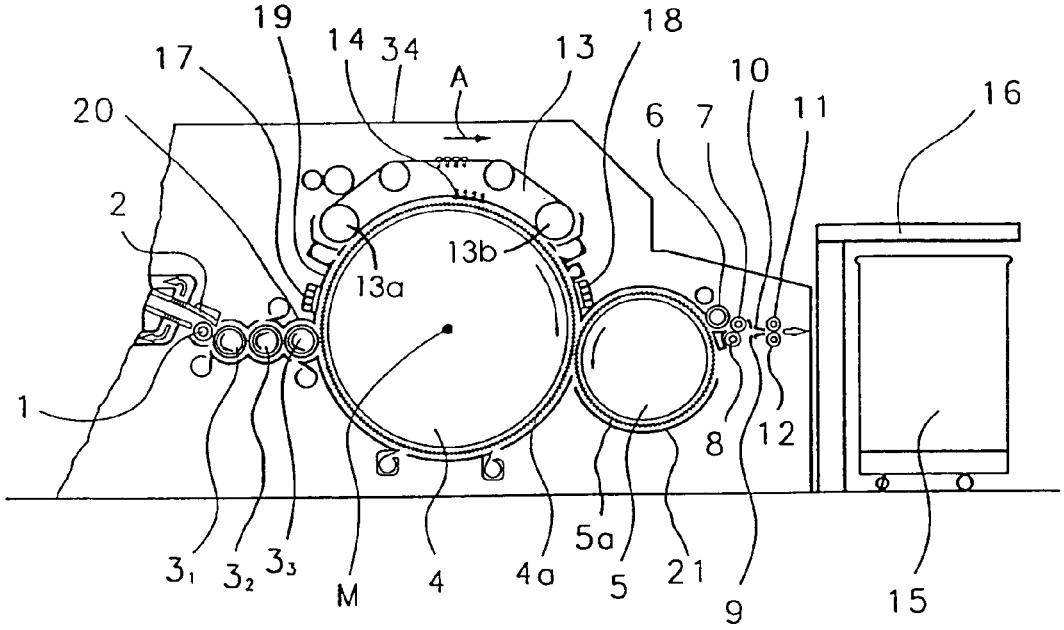
FIG. 1 is a diagrammatic side view of a carding machine for the device according to the invention.

FIG. 1 shows a carding machine, for example a high performance carding machine DK 903 made by Trützschler GmbH & Co KG of Mönchengladbach, Germany, having a feed roller 1, feed table 2, lickers-in $\mathbf{3}_1$, $\mathbf{3}_2$, $\mathbf{3}_3$, cylinder 4, doffer 5, stripper roller 6, nip rollers 7, 8, web guide element 9, sliver funnel 10, delivery rollers 11, 12, revolving card top 13 with card top bars 14, can 15 and coiler 16. The directions of rotation of the rollers are indicated by curved arrows. M denotes the centre point (of the axis or shaft) of the cylinder 4. Between licker-in 3 and card top guide roller 3*a* there are working elements, for example fixed carding segments 17, and between doffer 5 and card top guide roller 13*b* there are working elements, for example fixed carding elements 18. Reference numeral 19 denotes the cylinder covering (cylinder cover elements);. reference numeral 20 denotes the licker-in covering (cover elements) and reference numeral 21 denotes the doffer covering (cover elements). The cylinder 4 is provided with clothing 4*a*; the licker-in $\mathbf{3}_3$ is provided with clothing 3*a* and the doffer 5 is provided with clothing 5*a*. Reference letter A denotes the working direction. The carding machine is fully enclosed by a machinery housing 34, especially made of sheet metal with doors, flaps and the like.

Figure 2:
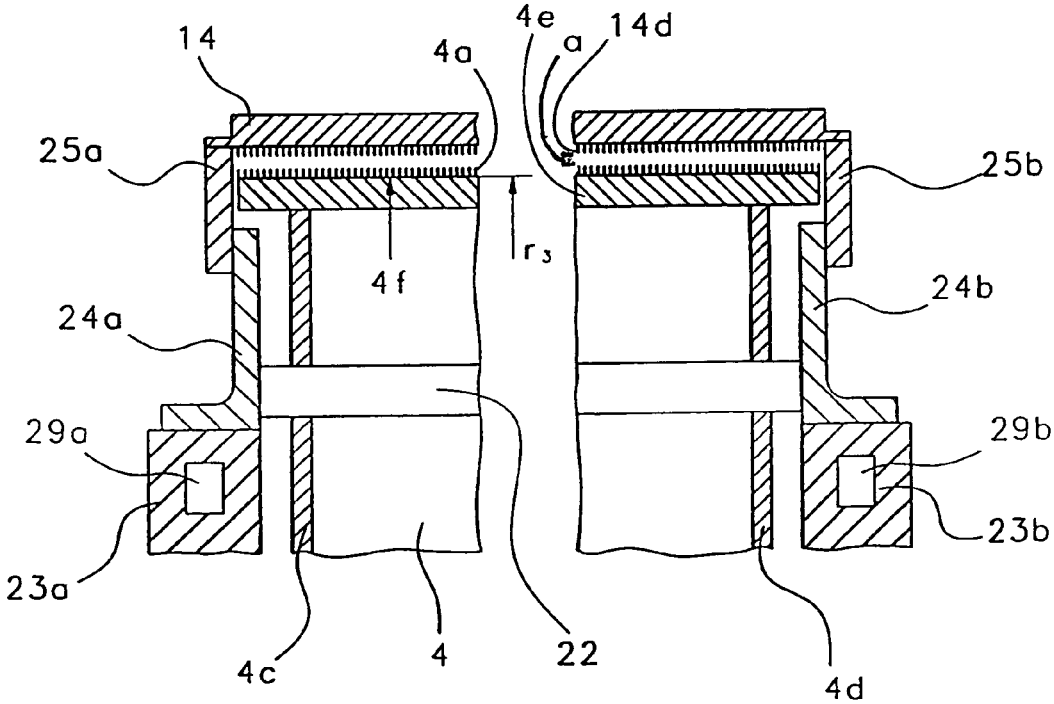
FIG. 2 shows, in diagrammatic form, a section through the cylinder with shaft, framework walls with heating elements and side panels.

FIG. 2 shows a portion of the cylinder 4 having a casing 4*e*, with a cylindrical surface 4*f*, and cylinder bases 4*c*, 4*d* (radial support elements). The surface 4*f* is provided with clothing 4*a*, which in this example is in the form of wire having sawteeth. The sawtooth wire is wound on the cylinder 4, that is to say is wound around it in closely adjacent turns between side flanges (not shown) in order to form a cylindrical working surface equipped with points. On the working surface, fibres should be processed as uniformly as possible. The carding work is performed between the opposing clothings. It is influenced essentially by the position of the one clothing relative to the other and by the clothing gap a between the tips of the teeth of the two clothings. The reference letter a is used herein to refer to both the gap between the cylinder clothing tips and the card top clothing tips and the gap between the clothing tips of licker-in $\mathbf{3}_3$ and the cylinder clothing tips, but that is not to be taken as implying that those gaps are equal. The working width of the cylinder 4 is a determining factor for all other working elements of the carding machine, especially for the revolving card top 14 or fixed card tops (a revolving top 14 is shown in the drawings) which, together with the cylinder 4, card the fibres uniformly over the entire working width. In order that uniform carding work can be performed over the entire working width, the settings of the working elements (including additional elements) must be adhered to over that working width. The cylinder 4 itself can, however, be deformed by the winding-on of the clothing wire, by centrifugal force or by heating arising as a result of the carding process. The shaft 22 of the cylinder 4 is rotatably mounted in bearings 26*a*, 26*b* (see FIG. 5*a*, 5*b* in which only bearing 26*a* can be seen) which are mounted on the fixed machinery framework 23*a*, 23*b*. The diameter, for example 1250 mm, of the cylindrical surface 4*f*, that is to say twice the radius $r_3$, is an important dimension of the machine and is increased by the working heat during operation. The side panels 24*a*, 24*b* are mounted on the two machinery frameworks 23*a*, 23*b*, respectively. The two flexible bends 25*a*, 25*b* are mounted on the side panels 24*a*, 24*b*, respectively. Heating devices 29*a*, 29*b* are provided, respectively, in machinery frameworks 23*a*, 23*b*.

Figure 3:
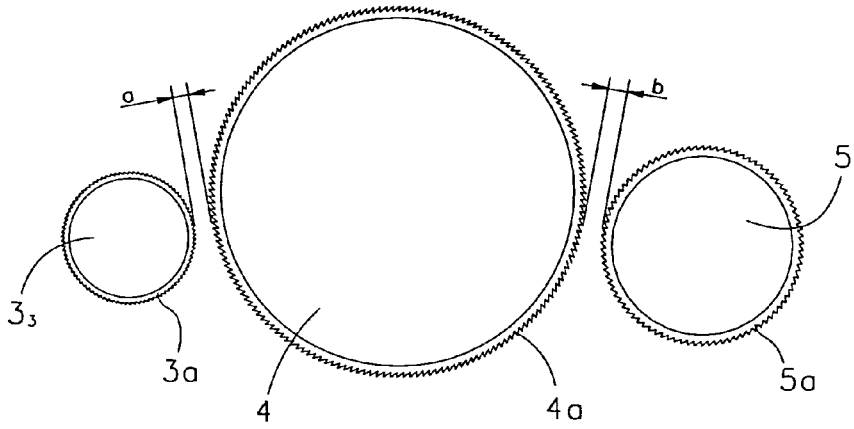
FIG. 3 shows the spacings of the clothed cylinder from a licker-in and from the doffer.

The rollers shown in FIG. 3 arranged immediately adjacent to the cylinder 4 and cooperating therewith, the licker-in $\mathbf{3}_3$ and the doffer 5, are constructed and clothed in substantially the same way as the cylinder 4, so that the comments made above in connection with the cylinder 4 in the description of FIG. 2 apply in corresponding manner. Between the points of the clothing 4*a* of the cylinder 4 on the one hand and the points of the clothing 3*a* of the licker-in $\mathbf{3}_3$ there is a roller gap a. Between the points of the clothing 4*a* of the cylinder 4 and, on the other hand, the points 5*a* of the doffer there is further a roller gap b. When, during operation, heat is generated in the carding gap by the carding work, especially in the case of a high production rate and/or the processing of synthetic fibres or cotton/synthetic fibre mixtures, the cylinder casing 4*e* is expanded, that is to say the radius $r_3$ increases and the roller gaps a and b become smaller. The heat is conducted by way of the cylinder casing 4*e* into the radial supporting elements, the cylinder bases 4*c* and 4*d*. The cylinder bases 4*c*, 4*d* likewise expand as a result, that is to say the radius $r_3$ (FIG. 2) increases. The cylinder 4 is virtually fully enclosed (encased) on all sides: in the radial direction by the elements 14, 17, 18, 19 (see FIG. 1) and to both sides of the carding machine by the elements 23*a*, 23*b*; 24*a*, 24*b*; 25*a*, 25*b*. The machinery housing 34 comes in addition. As a result of the increase in the diameter of the cylinder 4 caused by thermal and/or centrifugal force expansion, the roller gaps a and b become smaller. As a result of the features according to the invention, the roller gaps a and b are increased again to the distances required for optimum carding. The roller gaps between the surfaces, or clothings, of neighbouring rollers are thus set or readjusted.

Figure 4:
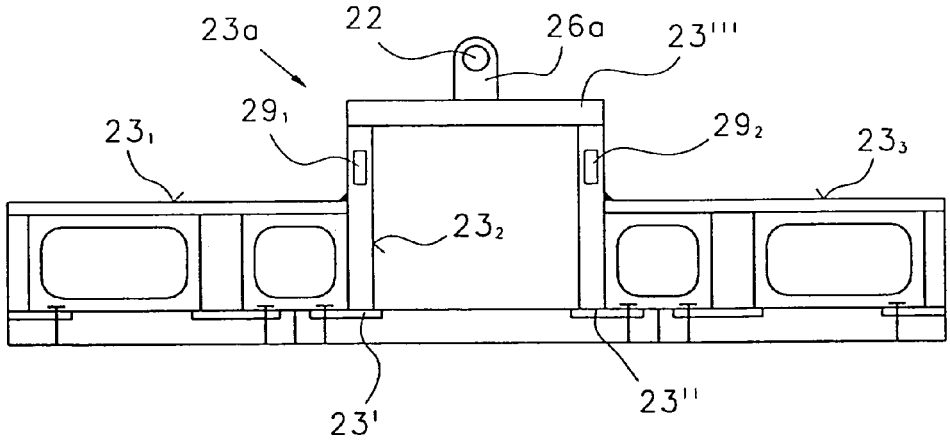
FIG. 4 is a side view of a carding machine framework wall with three framework part-walls for the cylinder, for a licker-in and for the doffer.

FIG. 4 shows the framework wall 23*a* on one side of the carding machine; the framework wall 23*b* (see FIG. 2) on the other side of the carding machine is basically of the same structure. The framework wall 23*a*—preferably made of sheet steel—consists of a framework wall 23, for the fibre feed, especially for mounting the feed device (feed roller 1, feed table 2) and the lickers-in $\mathbf{3}_1$ to $\mathbf{3}_3$, and of a framework wall $\mathbf{23}_3$ for mounting the fibre take-off elements, especially the doffer 5. On the upper crossmembers of the framework walls $\mathbf{23}_1$ and $\mathbf{23}_3$ there are fixedly mounted inter alia the pivot bearing 27*a* for the licker-in $\mathbf{3}_3$ and the pivot bearing 28*a* for the doffer 5 (see FIGS. 5*a* and 5*b*). Between the framework walls $\mathbf{23}_1$ and $\mathbf{23}_3$ there is located a framework wall $\mathbf{23}_2$ for mounting the cylinder 4. The framework wall $\mathbf{23}_2$ consists of two vertical support struts 23' and 23" which are joined to one another at their upper end by a horizontal crossmember 23'". On the crossmember 23'" there is fixedly mounted the pivot bearing 26*a* for the shaft 22 of the cylinder 4. The framework walls $\mathbf{23}_1$, $\mathbf{23}_2$ and $\mathbf{23}_3$ are joined to one another, for example by welding. The support struts 23' and 23" and the crossmember 23'" project above the upper boundary of the framework walls $\mathbf{23}_1$ and $\mathbf{23}_3$.

In each of the support struts 23', 23" (support columns), a heating rod $\mathbf{29}_1$, $\mathbf{29}_2$, respectively, is so arranged that the support struts 23' and 23" can be expanded or contracted in their longitudinal direction (that is to say in the vertical direction according to FIG. 4). The heating elements $\mathbf{29}_1$ and $\mathbf{29}_2$ are preferably arranged in the regions of the support struts 23' and 23" that project above the framework walls $\mathbf{23}_1$ and $\mathbf{23}_3$, because in those regions—irrespective of the welded bonds—free expansion is possible. The expansion of the support columns 23' and 23" is only small and takes place exclusively within the material of the support struts 23' and 23". As mentioned previously, the framework wall 23*b* on the other side of the carding machine is basically of the same structure and, in particular, includes correspondingly located heating rods.

Figure 5A:
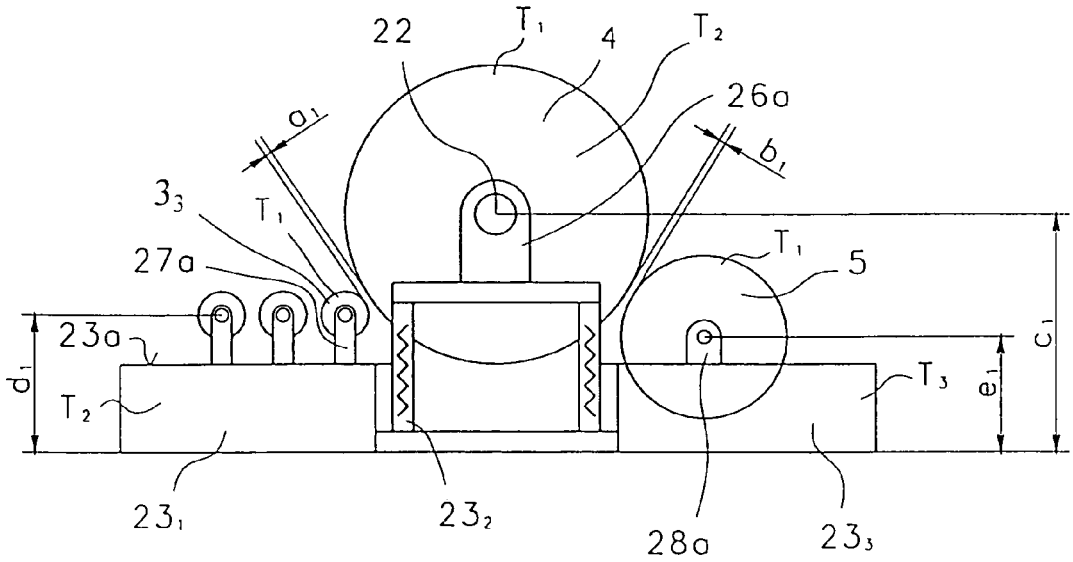
FIG. 5*a* is a side view of a carding machine with starting working gaps between the cylinder and a licker-in and the doffer.
Figure 5B:
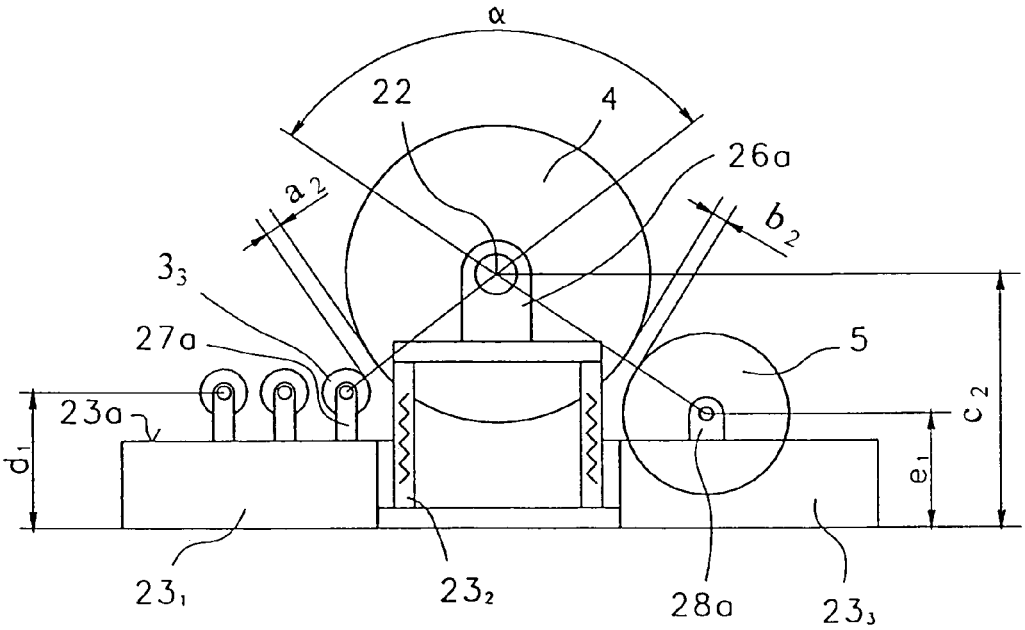
FIG. 5*b* is a side view of the carding machine of FIG. 5*a* showing changed working gaps.

In the embodiment of FIGS. 5*a* and 5*b*, before the carding machines are started into operation, for example at room temperature, there is a gap a between the cylinder 4 and the licker-in $\mathbf{3}_3$ on the one hand and a gap b between the cylinder 4 and the doffer 5 on the other hand, for example in each case $^8/_{1000}$". During operation of the carding machine, after the machinery, especially the rollers, has undergone heating, according to FIG. 5*a* the gaps between cylinder 4 and licker-in $\mathbf{3}_3$ and between cylinder 4 and doffer 5 have been reduced to $a_1$ and $b_1$, respectively, for example in each case $^2/_{1000}$". By means of the heating rods $\mathbf{29}_1$ and $\mathbf{29}_2$ shown in FIG. 2 and 4 (and—in a manner not shown—by means of the heating rods $\mathbf{29}_3$ and $\mathbf{29}_4$ in the support struts of the framework wall for the cylinder 4 in the framework wall 23*b* on the other side of the carding machine) the support struts 23' and 23" are expanded in the vertical direction. As a result, the crossmember 23'", the bearing 26*a* (and the bearing 26*b* not shown) and the axis 22 with the cylinder 4 are likewise raised upwards in the vertical direction. In this way the distance $c_1$ between the machinery or framework base and the centre point M of the shaft 22 (FIG. 5*a*) is increased to the distance $c_2$ (FIG. 5*b*). At the same time, the gaps $a_1$ and $b_1$ are increased to the gaps $a_2$ and $b_2$, respectively, which can be determined by geometric calculation. The distances $e_1$ and $d_1$ between the machinery or framework base and the centre point of the shaft of the doffer 5 and the centre point of the shaft of the licker-in $\mathbf{3}_3$ remain the same.

T1=temperature cylinder 4, licker-in $\mathbf{3}_3$, doffer 5

T2=temperature side panels 24*a*, 24*b*

T3=temperature framework 23

The temperature increases from the level of the rollers by way of the side panels as far as the machinery framework. In accordance with the invention, compensation for changes in the dimensions of the rollers is realised in a specific manner and with a low heat output.

The machinery framework 23 is so partitioned thermally that the cylinder 4 is raised by heating of its supports 23', 23", which are "insulated" from the remainder of the frame, measurements being taken of e.g. the cylinder temperature (T1) and the framework temperature (T3). The temperature (T4) to be set can then be determined by means of a simple calculation ($\Delta a = R \times \alpha \times \Delta T$ in which $\Delta a$ is the change in the working gap, R is a constant, $\alpha$ is the angle subtended at the axis of the cylinder by a first plane containing the axes of the cylinder 4 and the doffer 5 and a second plane containing the axes of the licker-in $\mathbf{3}_3$ and the cylinder 4; and $\Delta T$ is the difference in temperature between the actual framework temperature and the target temperature T4.). The spacings a, b of the rollers can be kept constant by controlling (see FIG. 6) the temperature T4. By raising T4, the columns 23', 23" (support struts) become longer and the cylinder 4 is raised relative to the remainder of the framework. Depending upon the angle ($\alpha$) and the temperature (T4), the greater thermal expansion of the rollers relative to the framework is compensated.

The heating of the support struts 23', 23" (columns) can advantageously be effected using commercially available apparatus (heating rod 29).

The gaps between neighbouring rollers or between their clothing surfaces can be determined, for example, in the manner described in DE-A-39 13 996.

Figure 6:
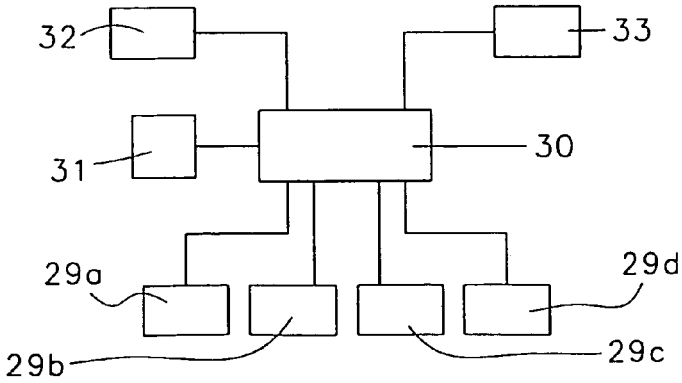
FIG. 6 is a block diagram showing the setting and readjustment of the working gaps between neighbouring rollers.

In the embodiment of FIG. 6, for setting or readjusting the working gaps a and b there is provided an electronic control and regulating device 30, for example a microcomputer having a microprocessor, to which a memory element 31 for predetermined working gaps a, b is connected. Furthermore, two measuring elements 32, 33 for the working gaps a, b are connected to the control and regulating device 30. The measuring elements 32, 33 can detect the working gaps directly or indirectly. Four heating elements 29*a* to 29*d* are connected to the control and regulating device 30. Measuring elements for the roller temperatures can be connected to the control and regulating device in a manner not shown.

Stepwise or stepless setting of the temperature of the heating elements 29*a* to 29*d* can be provided. As a result, supply and discharge of heat can be effected.

Although the foregoing invention has been described in detail by way of illustration and example for purposes of understanding, it will be obvious that changes and modifications may be practiced within the scope of the appended claims.

What is claimed is:

1. A carding machine having a carding cylinder supported by a support member and at least a first cooperating device in cooperating relationship with the carding cylinder, comprising an adjusting device for setting a working gap between the carding cylinder and said first cooperating device, the adjusting device comprising a thermal device for adjusting the temperature of the support member of the cylinder.

2. A carding machine according to claim 1, in which the first cooperating device is a clothed roller.

3. A carding machine according to claim 2, in which the clothed roller is a doffer.

4. A carding machine according to claim 3, further comprising a second cooperating device, said second cooperating device being a licker-in.

5. A carding machine according to claim 4, in which the temperature to be set for achieving a desired adjustment of the working gap is determinable in accordance with the relationship: $\Delta a = R \times \alpha \times \Delta T$ wherein $\Delta a$ is a change in the working gap, R is a constant, $\alpha$ is an angle subtended by at the axis of the cylinder by a first plane containing the axes of the cylinder and the doffer and a second plane containing the axes of the licker-in and the cylinder, and $\Delta T$ is a difference between an actual framework temperature and a target temperature.

6. A carding machine according to claim 1, in which the thermal device is so arranged that the temperature of the support member can be so matched to the working gap that, in the event of a change in the dimensions of the cylinder the working gap can be set or readjusted.

7. A carding machine according to claim 1, in which the support member comprises a framework wall and the thermal device comprises a heating device arranged for heating at least one element of the framework wall.

8. A carding machine according to claim 7, in which the framework wall includes a heating element.

9. A carding machine according to claim 1, in which there is at least one heating element on each side of the carding machine.

10. A carding machine according to claim 9, in which the temperature of the or each heating element is adjustable.

11. A carding machine according to claim 1, having at least one framework wall that has at least two support struts on each side and a crossmember, and in which the support struts are expandable or contractable in the vertical direction.

12. A carding machine according to claim 1, in which the cylinder and at least one neighbouring roller are arranged on their own respective framework walls or struts.

13. A carding machine according to claim 12, in which the cylinder is arranged on a framework that is higher than a framework of at least one neighbouring roller and the thermal device comprises at least one heating element arranged in the region of the cylinder framework that projects above the framework of a neighboring roller.

14. A carding machine according to claim 1, comprising at least one temperature-measuring element associated with the cylinder.

15. A carding machine according to claim 1, comprising a doffer in cooperating relationship with the cylinder, and at least one temperature-measuring element associated with the doffer.

16. A carding machine according to claims 1, comprising a licker-in in cooperating relationship with the cylinder and at least one temperature-measuring element.

17. A carding machine according to claim 1, in which there are temperature-measuring elements associated with the surfaces of one or more rollers.

18. A carding machine according to claim 1, comprising an electronic control and regulating device to which the thermal device and at least one temperature-measuring element are connected.

19. A carding machine according to claim 1, comprising a gap-measuring element for determining the gap between two neighbouring rollers.

20. A carding machine having a carding cylinder and at least one clothed roller in cooperation with the cylinder, and further comprising an adjusting device for setting a working gap between the cylinder and said clothed roller, the adjusting device comprising a thermal device for adjusting the temperature of a support member that carries the cylinder for carrying thermal expansion or contraction of at least a part of the support member, the carding machine further comprising a temperature-measuring device for measuring the temperature of at least one of the clothed roller and the cylinder, a gap-measuring device for measuring said working gap and a control device to which said thermal device, said temperature-measuring device and said gap-making device are connected to the control device for effecting adjustment of the working gap in dependence on the measured gap.

21. A device on a carding machine for setting the working gap between the cylinder and at least one neighbouring roller, which cooperate with one another with a small gap between their cylindrical surfaces (working gap) at the fibre transfer points and in which the working gap is readjustable to pre-determined value as a result of changes in dimensions caused by thermal expansion and/or centrifugal forces, wherein the temperature of the framework walls carrying the cylinder can be so matched to the working gap by means of devices for supplying or discharging heat that in the event of a change in the dimensions of the rollers the working gap between the cylinder and at least one neighboring roller can be set or readjusted.

* * * * *